US010273732B2

(12) United States Patent
Hung

(10) Patent No.: US 10,273,732 B2
(45) Date of Patent: Apr. 30, 2019

(54) LIGHTLY OPENING AND BUFFERABLY CLOSING DOOR CLOSER

(71) Applicant: D&D Builders Hardware Co., Taichung (TW)

(72) Inventor: Tien-Lin Hung, Taichung (TW)

(73) Assignee: D&D Builders Hardware Co., Ltd., Taichung (TW)

( * ) Notice: Subject to any disclaimer, the term of this patent is extended or adjusted under 35 U.S.C. 154(b) by 65 days.

(21) Appl. No.: 15/481,019

(22) Filed: Apr. 6, 2017

(65) Prior Publication Data

US 2017/0335614 A1 Nov. 23, 2017

(30) Foreign Application Priority Data

May 23, 2016 (TW) ..... 105207526 U

(51) Int. Cl.

| | |
|---|---|
| ***E05F 3/02*** | (2006.01) |
| ***E05F 1/10*** | (2006.01) |
| ***E05F 1/08*** | (2006.01) |
| ***E05F 3/18*** | (2006.01) |
| ***E05F 3/22*** | (2006.01) |

(52) U.S. Cl.

CPC ..... *E05F 3/02* (2013.01); *E05F 1/08* (2013.01); *E05F 1/1091* (2013.01); *E05F 3/18* (2013.01); *E05F 3/227* (2013.01)

(58) Field of Classification Search

CPC .. F15B 15/16; F15B 15/22; E05F 3/00; E05F 3/02; E05F 1/08; E05F 1/10; E05F 1/1008; E05F 1/1025; E05C 17/30; E05C 17/305; Y10T 292/28; Y10T 292/25; Y10S 292/12; Y10S 292/15; Y10S 292/19; Y10S 292/56; Y10S 292/73; F16F 9/50

See application file for complete search history.

(56) References Cited

U.S. PATENT DOCUMENTS

| | | | | | |
|---|---|---|---|---|---|
| 2,881,467 | A * | 4/1959 | Struhar | E05F 3/02 | 16/66 |
| 3,687,015 | A * | 8/1972 | Chavarria | F15B 15/16 | 92/132 |
| 3,893,377 | A * | 7/1975 | Mannetje | F15B 1/02 | 60/371 |
| 4,075,929 | A * | 2/1978 | Peterson | F15B 15/16 | 91/168 |
| 4,974,285 | A * | 12/1990 | Enrietti | B60N 3/08 | 16/66 |

(Continued)

*Primary Examiner* — Emily M Morgan
(74) *Attorney, Agent, or Firm* — Wang Law Firm, Inc.

(57) ABSTRACT

A door closer includes: a cylinder secured on a door frame and having a cylinder head formed on a proximal end of the cylinder; a main value and a check valve respectively formed on the cylinder head to control the air in-and-out volume through the valves for lightly opening the door; a piston secured to a rod member slidably reciprocating within the cylinder with the rod member secured to a door; a restoring spring secured between the cylinder head and the rod member for normally resiliently restoring the rod member and the piston towards the cylinder head in order to close the door to the door frame normally as restored by the restoring spring; and at least a buffer member secured between the cylinder head and the piston so as to dampen the inertia force of the closing door to eliminate the noise or damage thus possibly caused.

11 Claims, 14 Drawing Sheets

(56) References Cited

U.S. PATENT DOCUMENTS

| | | | | |
|---|---|---|---|---|
| 5,390,586 | A * | 2/1995 | Jones | F15B 15/16<br>91/167 R |
| 2003/0141638 | A1* | 7/2003 | Salice | E05F 1/16<br>267/34 |
| 2003/0167912 | A1* | 9/2003 | Dawson | F15B 15/1428<br>91/151 |
| 2012/0074660 | A1* | 3/2012 | Thomas | B60G 17/021<br>280/5.514 |
| 2013/0047835 | A1* | 2/2013 | Tobias | B64D 1/12<br>92/61 |
| 2013/0284010 | A1* | 10/2013 | Allard | F15B 15/16<br>91/157 |
| 2017/0241452 | A1* | 8/2017 | Lewendon | F15B 15/261 |
| 2018/0156248 | A1* | 6/2018 | Birje | F15B 15/16 |

* cited by examiner

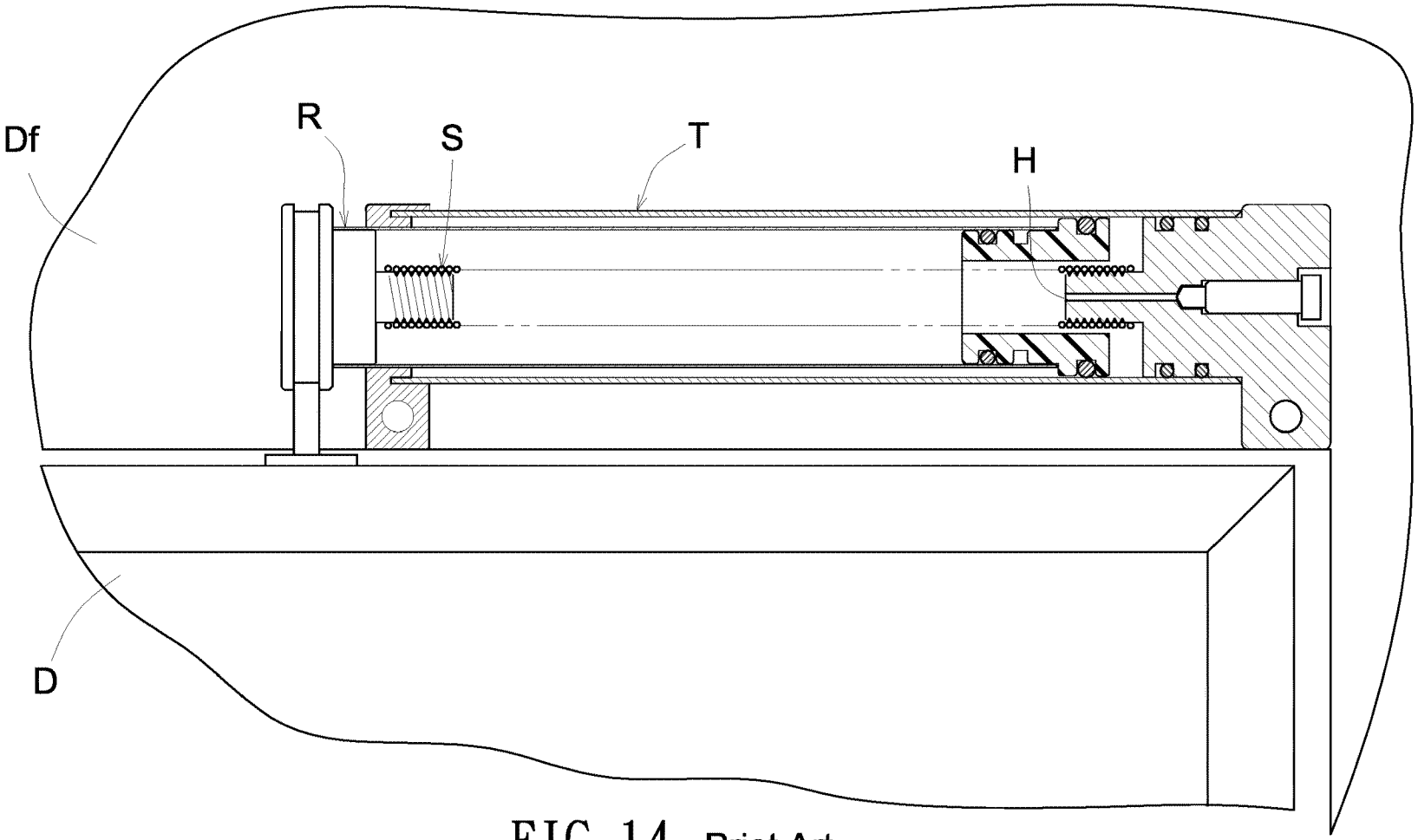
FIG. 14 Priot Art

LIGHTLY OPENING AND BUFFERABLY CLOSING DOOR CLOSER

RELATED APPLICATION

This application claims the benefit of a Taiwanese patent application, 105207526, filed on May 23, 2016, the specification of which is incorporated here by this reference.

BACKGROUND OF THE INVENTION

A conventional door closer as shown in FIG. 14 comprises: an outer tube (T) fixed on a door frame (Df) and having an air hole (H) formed in a head portion of the door closer; a rod member (R) slidably moving in the outer tube (T) and secured to a door (D) opening from (or closing to) the door frame (Df); and a restoring spring (S) secured between the rod member (R) and the head portion of the outer tube (T); whereby upon pulling the rod member (R) and the door (D) to be separated from the door frame (Df), the air may be sucked into the tube (T) through the air hole (H) to fill the chamber in the tube (T); and when closing the door (D) by releasing the rod member (R), the air will be expelled or vented outwardly through the air hole (H) to retract the rod member (R) to approximate the door frame in order to close the door automatically as restored by the restoring spring (S).

However, such a prior art has the following drawbacks:

1. Only one tiny air hole (H) is provided so that it requires a great force to pull the rod member (R) outwardly when opening the door in order to overcome the vacuum force as existing in the chamber within the tube (T) when pulling such rod member (R), thereby easily causing the user tiredness.
2. When it is intended to temporarily keep the door at an opening state, the door, as lacking of temporary braking or stopping mechanism, will be automatically restored, once opened, as restored by the restoring spring to immediately close the door, thereby causing inconvenience for the user if he or she wants to come in or go out through the door by repeatedly opening the door.
3. When the door is restored to close by the spring (S), the rod member (R) as urged by the spring (S) may impact the related parts or elements of the conventional door closer to cause noise or may even damage the door closer due to the inertia force when resiliently restored or retracted to close the door.

The present inventor has found the drawbacks of the conventional door closer and therefore invented the door closer as lightly opened and bufferably closed.

SUMMARY OF THE INVENTION

The object of the present invention is to provide a door closer including: a cylinder secured on a door frame and having a cylinder head formed on a proximal end of the cylinder; a main valve and a check valve respectively formed on the cylinder head to control the air in-and-out volume through the valves for lightly opening the door; a piston secured to a rod member slidably reciprocating within the cylinder with the rod member secured to a door; a restoring spring secured between the cylinder head and the rod member for normally resiliently restoring the rod member and the piston towards the cylinder head in order to close the door to the door frame normally as restored by the restoring spring; and at least a buffer member secured between the cylinder head and the piston so as to dampen the inertia force of the closing door to eliminate the noise or damage possibly caused.

Another object of the present invention is to provide a door closer including a magnet fixed on the rod member and a ferromagnetic member formed on the door frame or a fixture near the doorframe, whereby when opening the door to allow the magnet on rod member of door to approximate the ferromagnetic member on the door frame, the rod member with the door will be magnetically attracted to the ferromagnetic member, thereby temporarily attracting the door at an opening state for a convenient frequent in-and-out passing through the door opening by the user.

BRIEF DESCRIPTION OF THE DRAWINGS

FIG. 14 shows a prior art.

DETAILED DESCRIPTION

Figure 1:
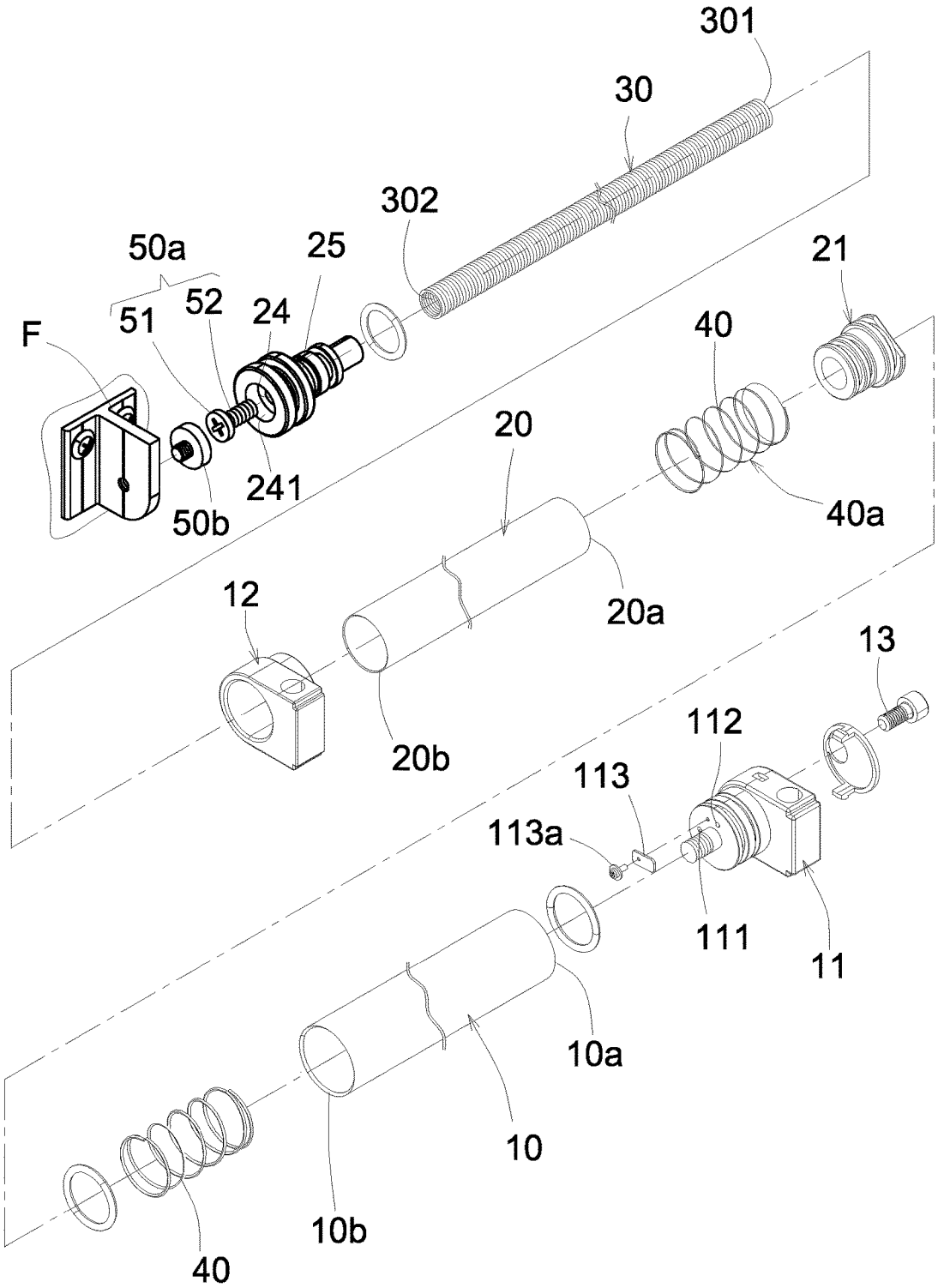
FIG. 1 is an exploded view of a first preferred embodiment of the present invention.
Figure 2:
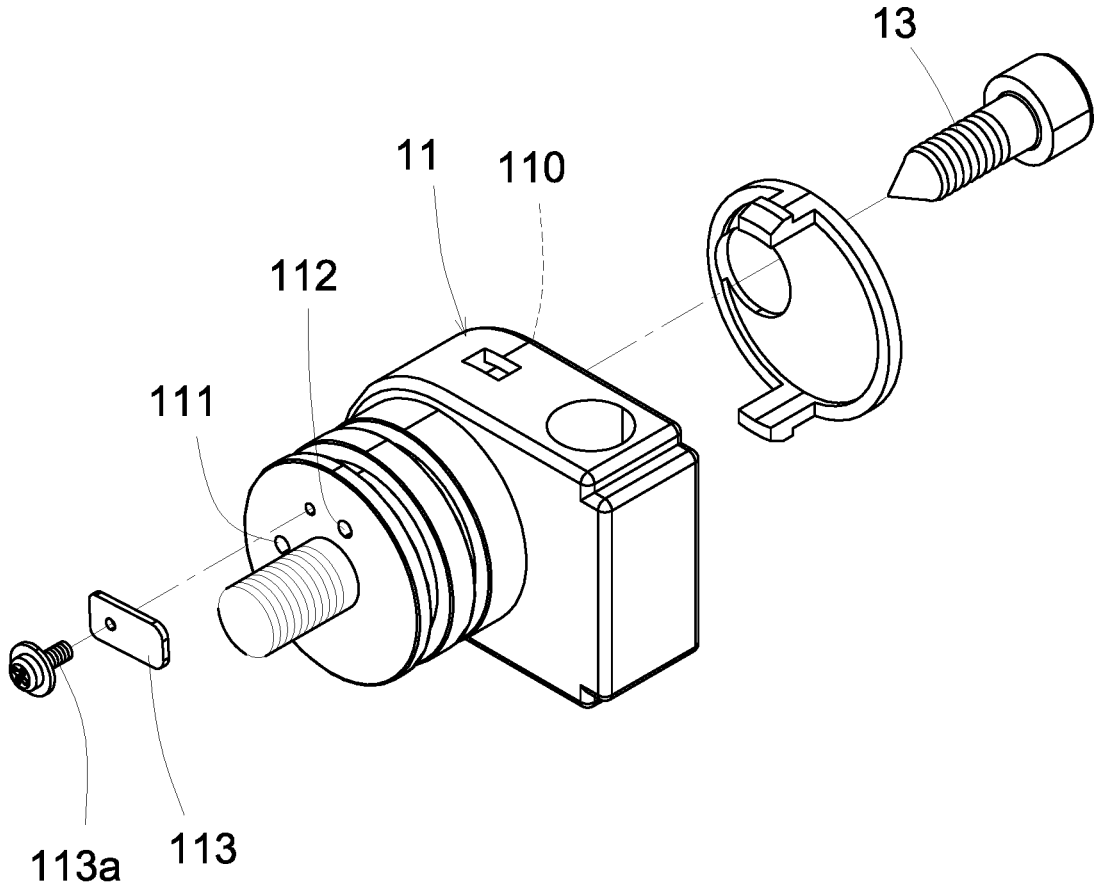
FIG. 2 is an exploded view of a cylinder head of the present invention.

As shown in FIGS. 1~5, a door closer of the present invention comprises: a cylinder 10 secured to a door frame Df; a rod member 20 including a piston 21 formed on a proximal end of the rod member 20 and slidably reciprocating in the cylinder 10; a restoring spring 30 including a proximal spring end 301 secured to a cylinder head 11 of the cylinder 10 and a distal spring end 302 secured to a pulling member 25 of the rod member 20 for normally resiliently restoring the rod member 20 and the piston 21 towards the cylinder head 11 of the cylinder 10 for closing a door D as secured with the pulling member 25; a main valve V1 formed on the cylinder head 11 for controlling air in-and-out through the main valve V1; a check valve V2 formed on the cylinder head 11 opposite to the main valve V1 allowing an one-way entrance of air entering a buffer chamber C defined among the cylinder head 11, the cylinder 10 and the piston 21 (FIG. 5) when pulling the rod member 20 for opening the door D; and at least a buffer element 40 secured between the cylinder head 11 and the rod member 20, whereby when the rod member 20 is resiliently restored by the restoring spring 30, the inertia force of the rod member 20, as being restored and retracted towards the cylinder head 11, will be dampened or weakened by the buffer member 40 to prevent noise and damage of the related elements of the door closer. If not acted by external force, the restoring spring 30 serves as a positioning device to stabilize the relative positions of the cylinder 10 and the rod member 20.

The buffer member 40 may be a compression spring; or may be a flexible, elastic and compressible element 40', including a coil, a bellows, etc. (FIG. 12), not limited in this invention. Such a flexible, elastic and compressible element 40' may be made of elastomers, including rubber, silicon rubber, or foam, also not limited in this invention.

Figure 5:
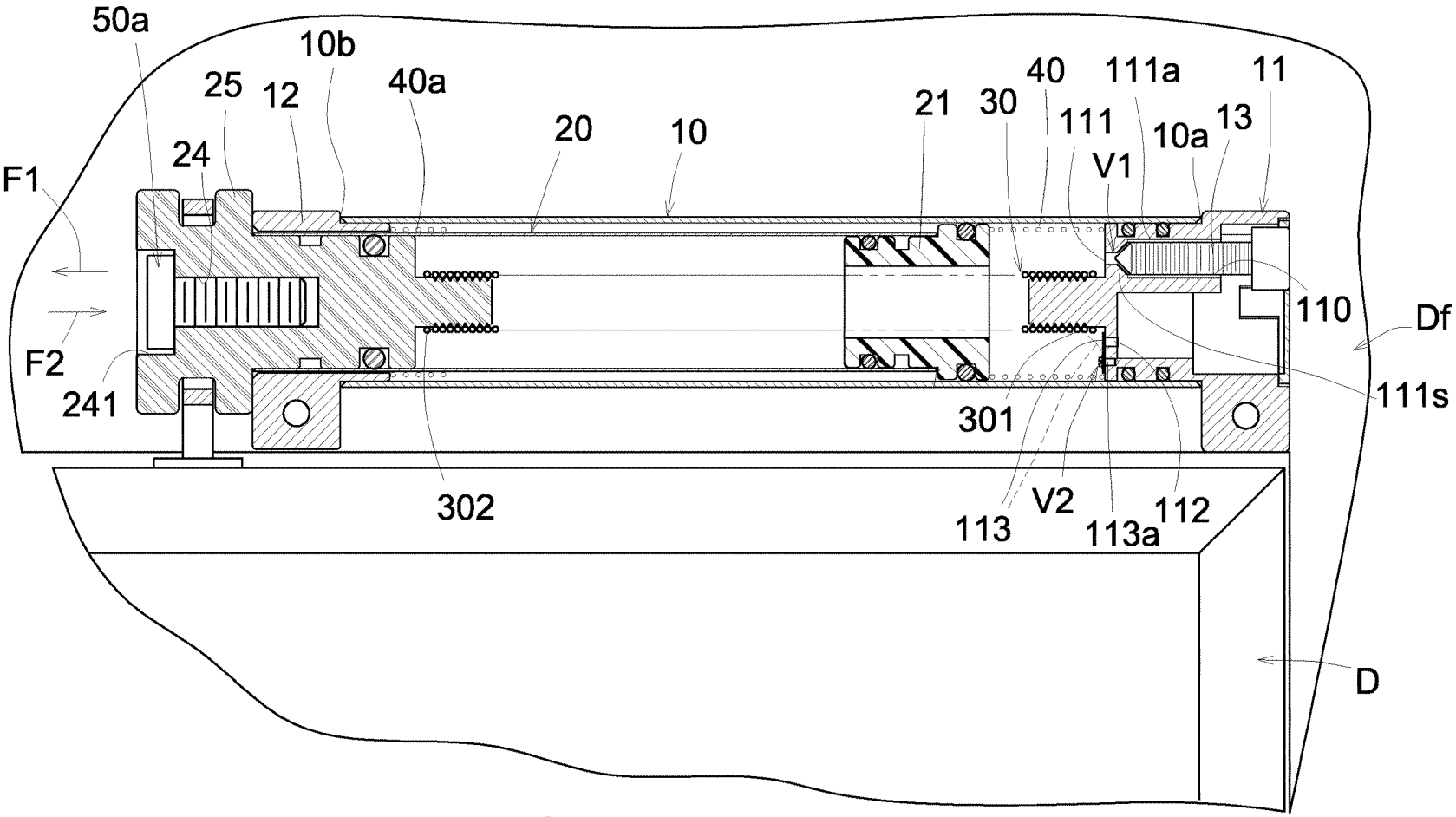
FIG. 5 is a sectional drawing of the first preferred embodiment of the present invention.

The main valve V1 includes: a male-threaded plug 13 rotatably engaged with a female-threaded hole 110 formed in the cylinder head 11, a conical valve seat 111*s* formed in the cylinder head 11 to face a conical end of the plug 13, a main hole 111 formed through the main valve seat 111*s* of the cylinder head 11 for entering air into the buffer chamber C when pulling the rod member 20 and the piston 21 outwardly for opening the door D for increasing the air volume in the buffer chamber C (as pulling force or direction F1 as shown in FIG. 5).

Figure 3:
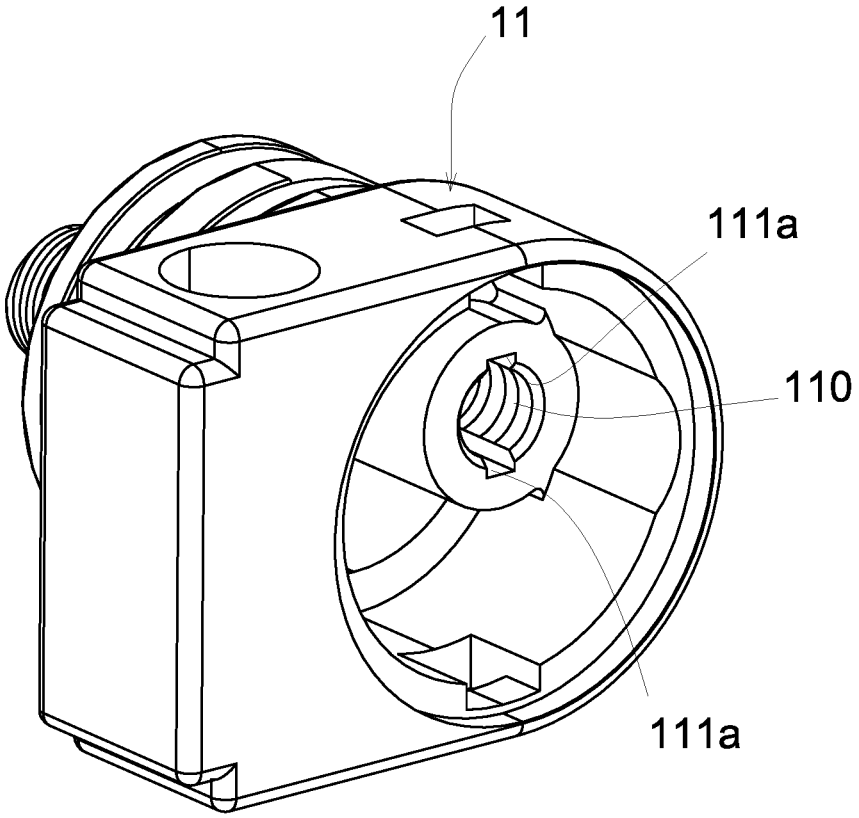
FIG. 3 is a perspective view of the cylinder head when assembled.
Figure 4:
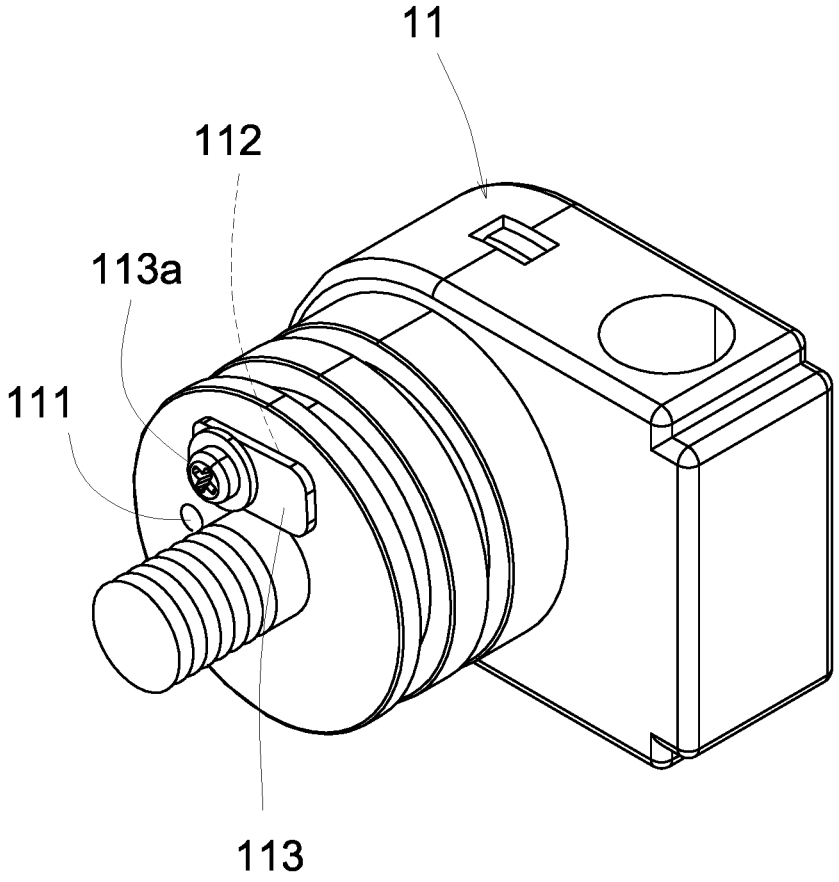
FIG. 4 shows the cylinder head in another view.

The entering (or releasing) air volumetric flow rate can be adjusted by adjusting the valve opening between the plug 13 and the main valve set 111*s*, thereby adjusting the air volumetric flow rate through the valve opening as entered (or released) through an air passage 111*a* as recessed diametrically in the female-threaded hole 110 formed in the cylinder head 11 (FIGS. 5 and 3).

For simplifying or cost-down purpose, the main valve V1 may be modified to be an air opening through the cylinder head 11, by eliminating the plug 13 and the related structure or elements as afore-mentioned.

The check valve V2, as shown in FIGS. 1, 2, 4 and 5, includes: a flap 113 pivotally secured to the cylinder head 11 by a fixing screw 113*a*, and a check-valve hole 112 formed through the cylinder head 11, whereby when pulling the rod member 20 and piston 21 outwardly when opening the door D as arrow mark F1 as shown in FIG. 5, the air may enter the buffer chamber C through the main hole 111 and the volume of the buffer chamber C is now expanded suddenly to form a partial vacuum within the chamber C so that the external air will be suddenly or quickly led, through the check-valve hole 112, to open the flap 113 of the check valve V2 to enter the chamber C. Simultaneously, another air stream will enter the buffer chamber C through the main hole 111 of the main valve V1. Therefore, the two air streams respectively flowing through the two holes 111, 112 will soonly occupy the buffer chamber C to "remove" the vacuum in the chamber C. In other words, the piston 21 and the rod member 20 as well as the door will be pulled, in a lighter force, more smoothly and more quickly.

Contrarily, when closing the door, the restoring spring 30 will restore the rod member 20 and the piston 21 inwardly towards the cylinder head 11 to compress air in the buffer chamber C, the flap 113 of the check valve V2 as subjected to the compressed air pressure within the chamber C will be biased to close the check-valve hole 112. At this time, the air in the chamber C can only be released through the main hole 111 of the main valve V1 (since the check valve V2 is now closed). It means that the air in the buffer chamber C is released slowly through the only hole, the main hole 111, to the exterior. The air pressure existing in the chamber C will then dampen the inward-moving piston 21 and rod member 20 as well as the door D secured thereto. So, the door is closed in a bufferable way, thereby preventing damage of the related elements of the door closer and eliminating noise caused by the inertia force of the piston and rod member when inwardly restored (F2).

The cylinder 10 may be formed as a hollow tube or pipe as shown in FIGS. 1~5. The cylinder 10 includes a first end 20*a* which is secured with the piston 21, and a second end 20*b* which is secured with an end retainer 12 for limiting or retaining an outward moving of the piston 21 and the rod member 20 slidably reciprocating within the cylinder 10. An auxiliary buffer member 40*a* is formed on an inner edge of the end retainer 12 so as to serve as a buffer for dampening an actuation or impact force when outward moving of the piston and rod member when opening the door (F1).

Figure 6:
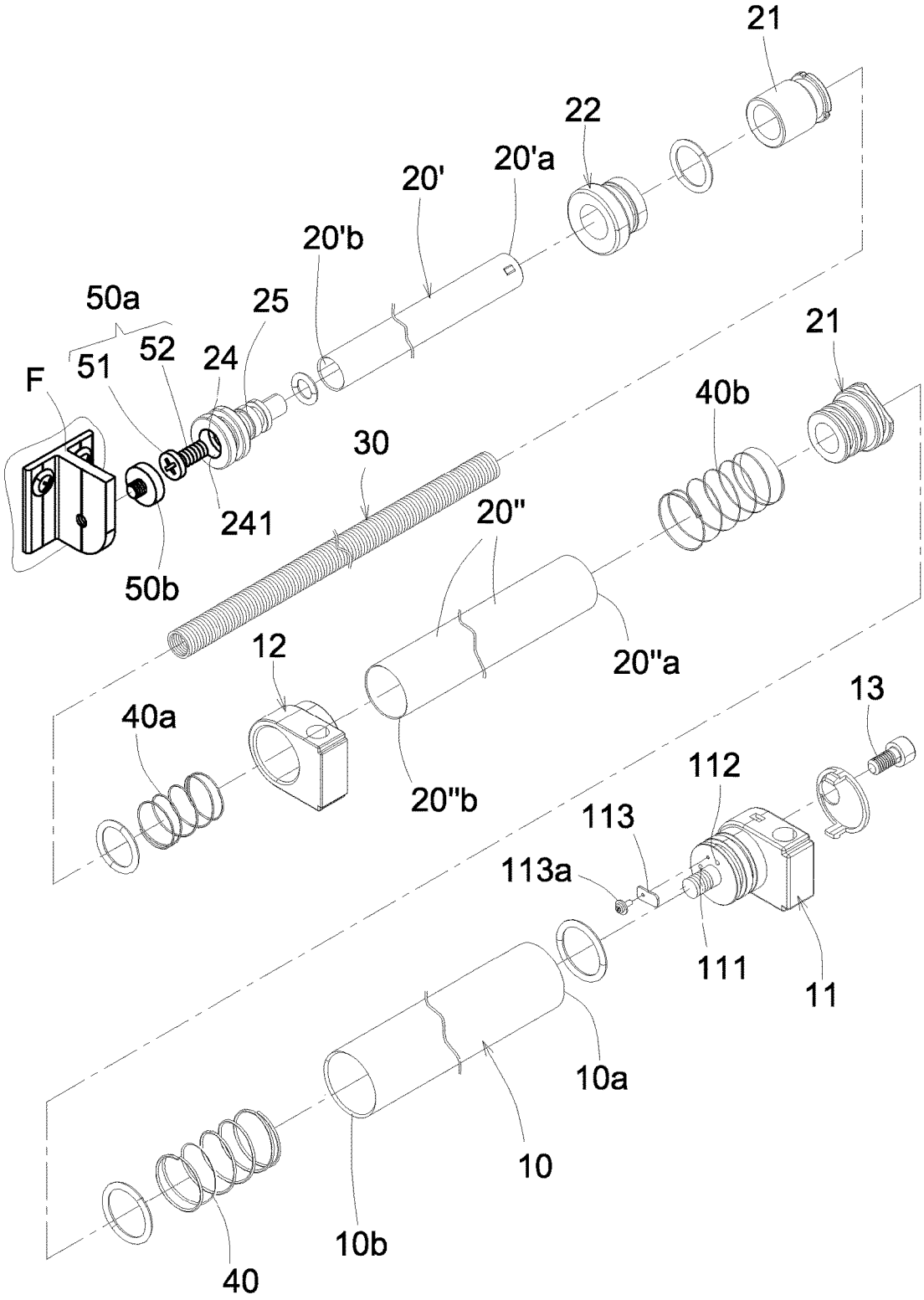
FIG. 6 is an exploded view of a second preferred embodiment of the present invention.
Figure 7:
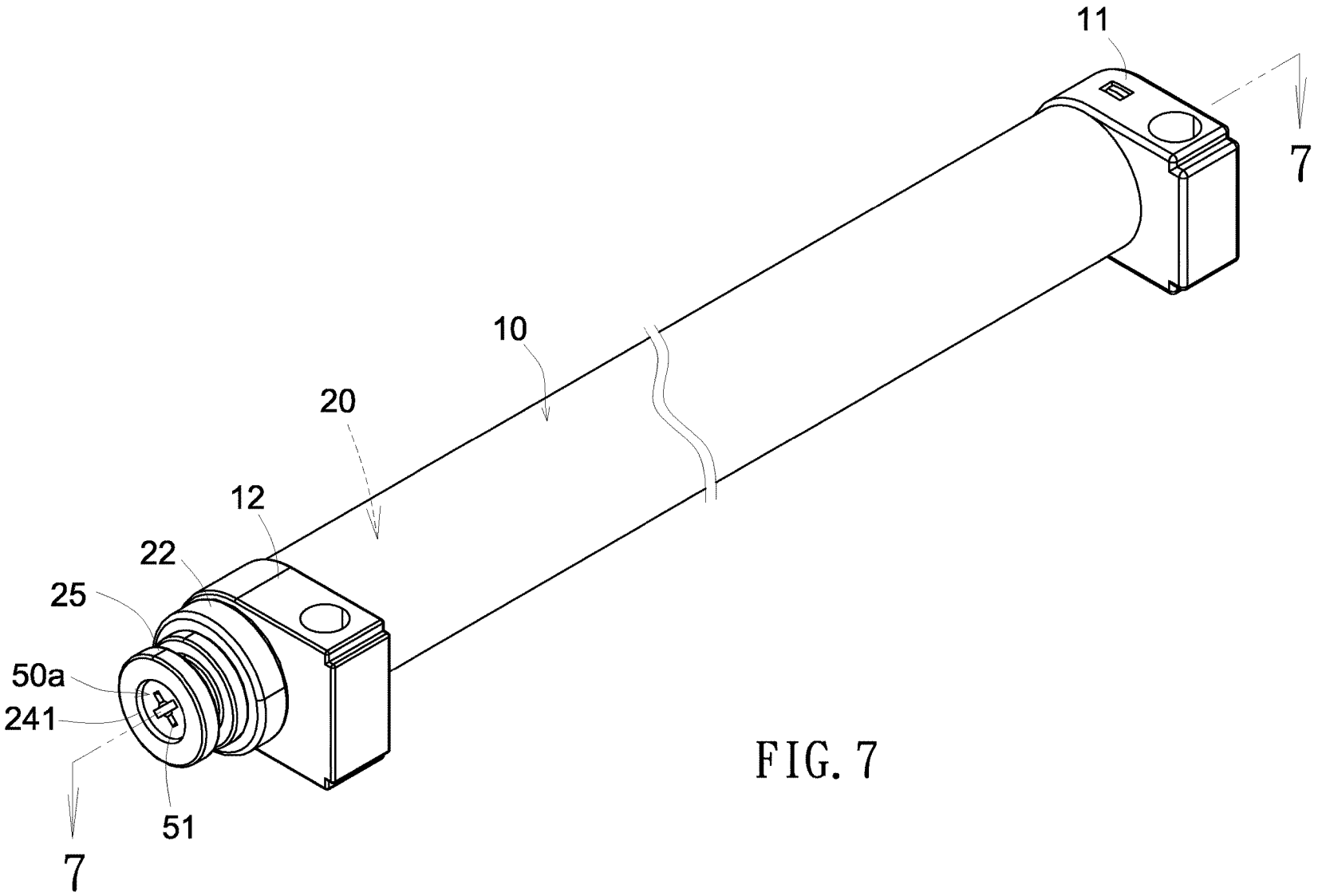
FIG. 7 is a perspective view when assembled from FIG. 6.
Figure 8:
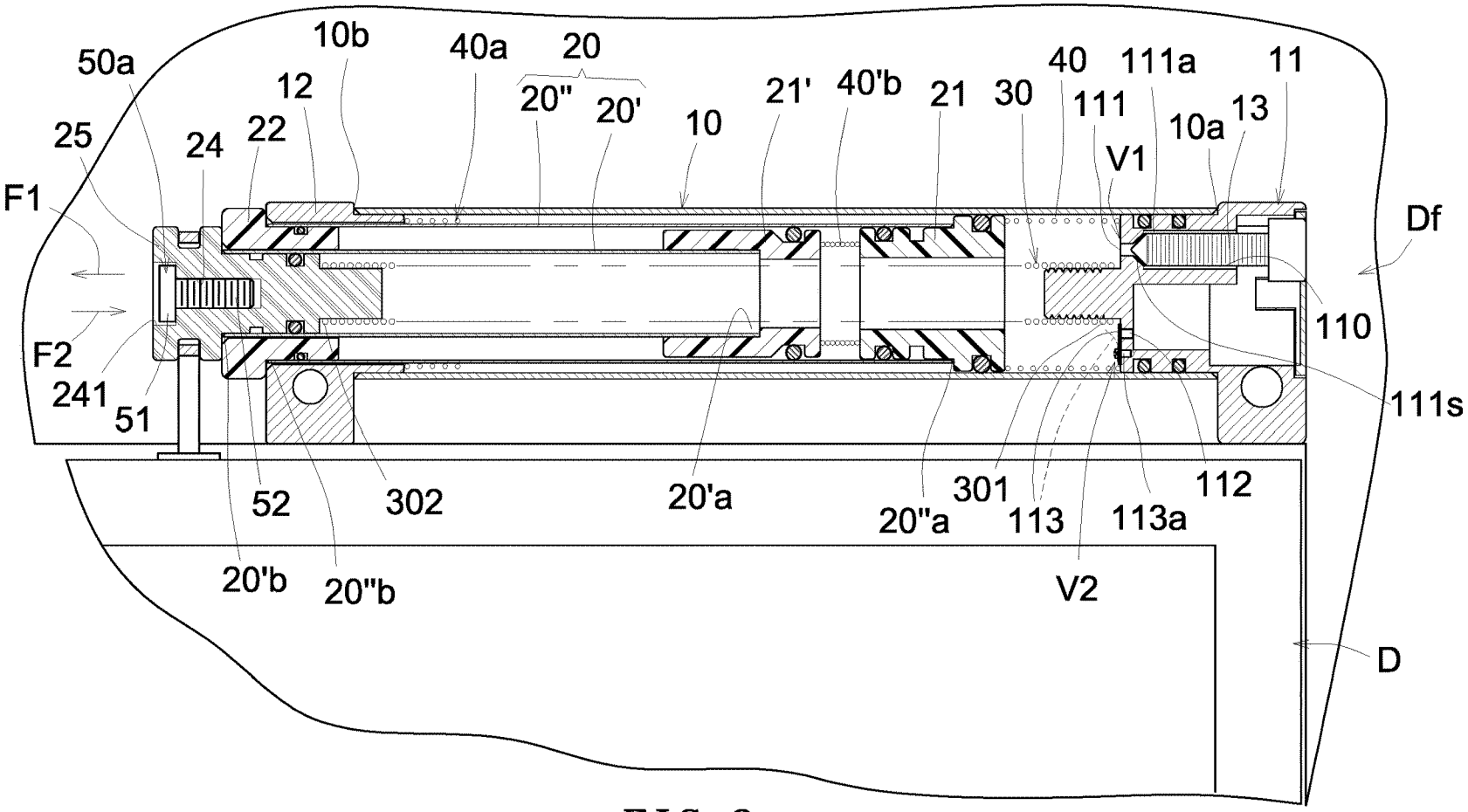
FIG. 8 is a sectional drawing when viewed from Line 7-7 of FIG. 7.

As shown in FIGS. 6~8, the rod member 20 may include a set of telescopic hollow tubes 20', 20" telescopically engageable with each other so that the tubes 20', 20" may be extended when opening the door or folded when closing the door. However, the tube number of the set of telescopic tubes of this invention is not limited, e.g., two, three or more tubes telescopically engageable with one another.

Figure 10:
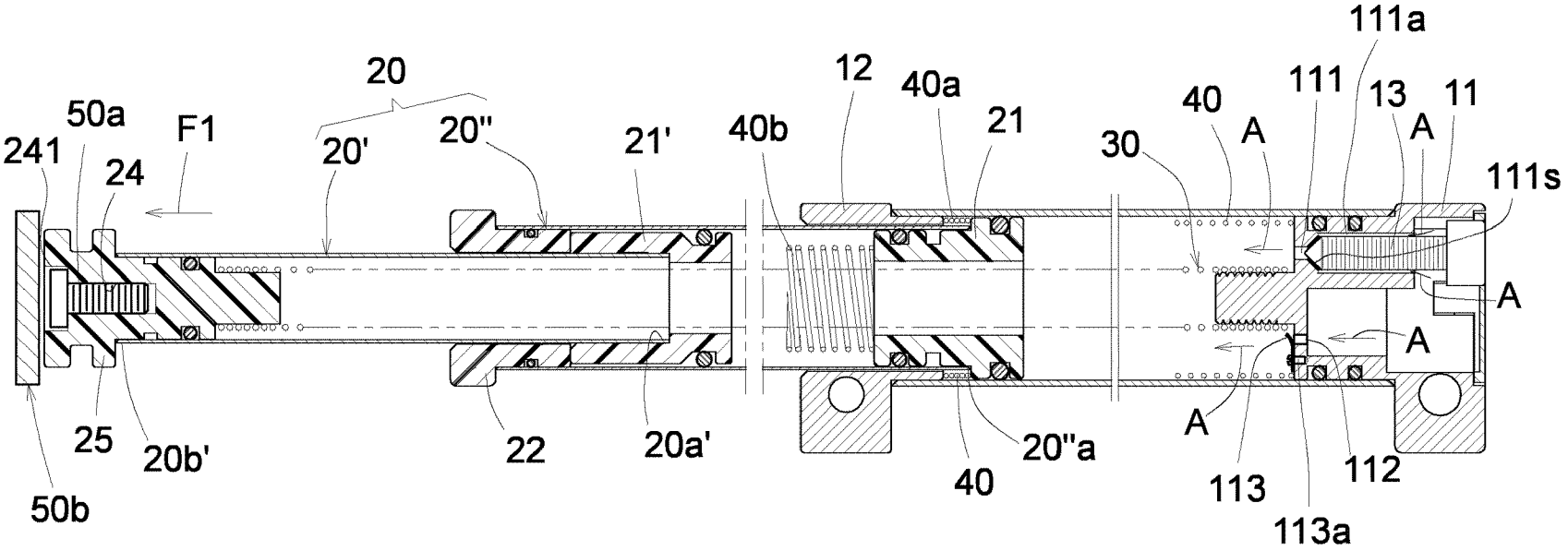
FIG. 10 shows a further pulling of the rod member from FIG. 9.

An outer tube 20" of the rod member 20 includes a first end 20"*a* secured with a first piston 21 to be slidably reciprocating within the cylinder 10, and a second end 20"*b* secured with a tube retainer 22 to prevent outward releasing of an inner tube 20' when telescopically extending the tubes 20", 20' when opening the door (especially as shown in FIG. 10), as limited by the tube retainer 22.

Figure 9:
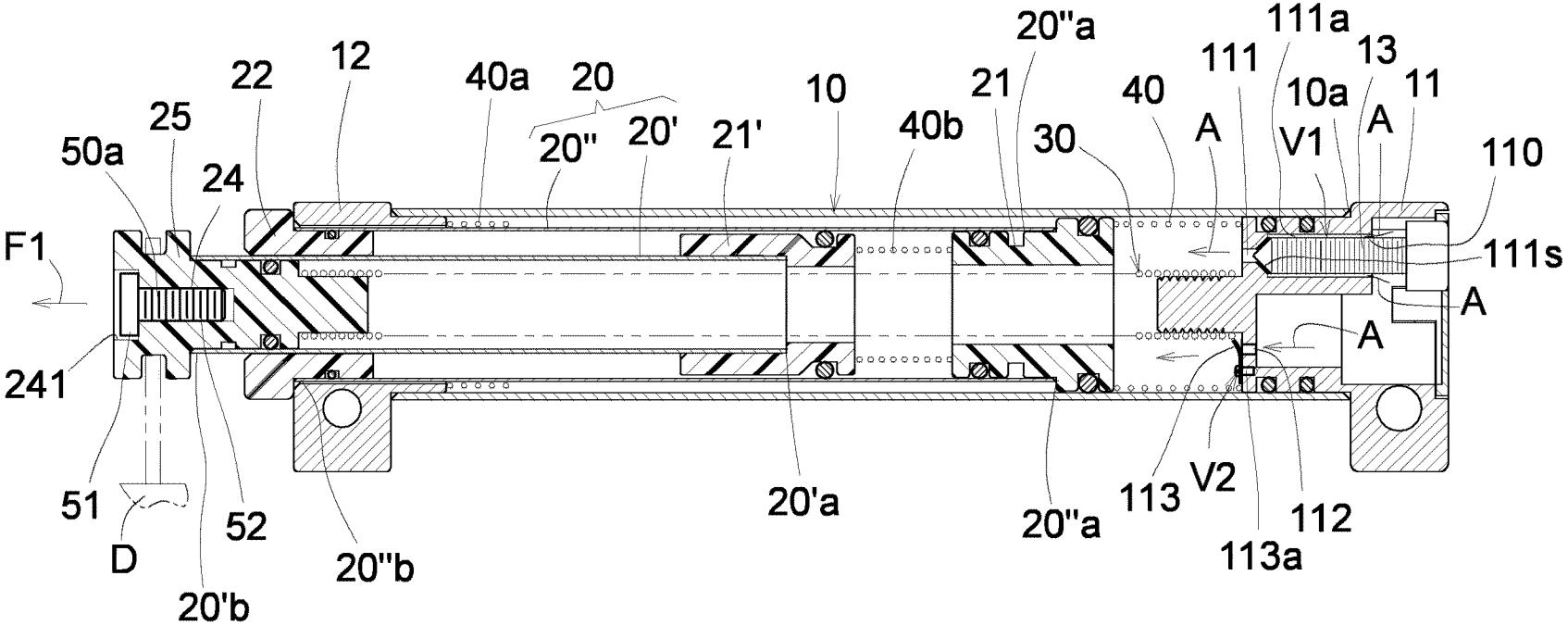
FIG. 9 is an illustration showing an outward pulling of the rod member from FIG. 8.

The inner tube 20' of the rod member 20 includes a first end 20'a secured with an inner piston 21' to be slidably reciprocating within the outer tube 20", and a second end 20'*b* secured to a pulling member 25 to be pulled outwardly when opening the door D (FIGS. 9, 10).

Figure 11:
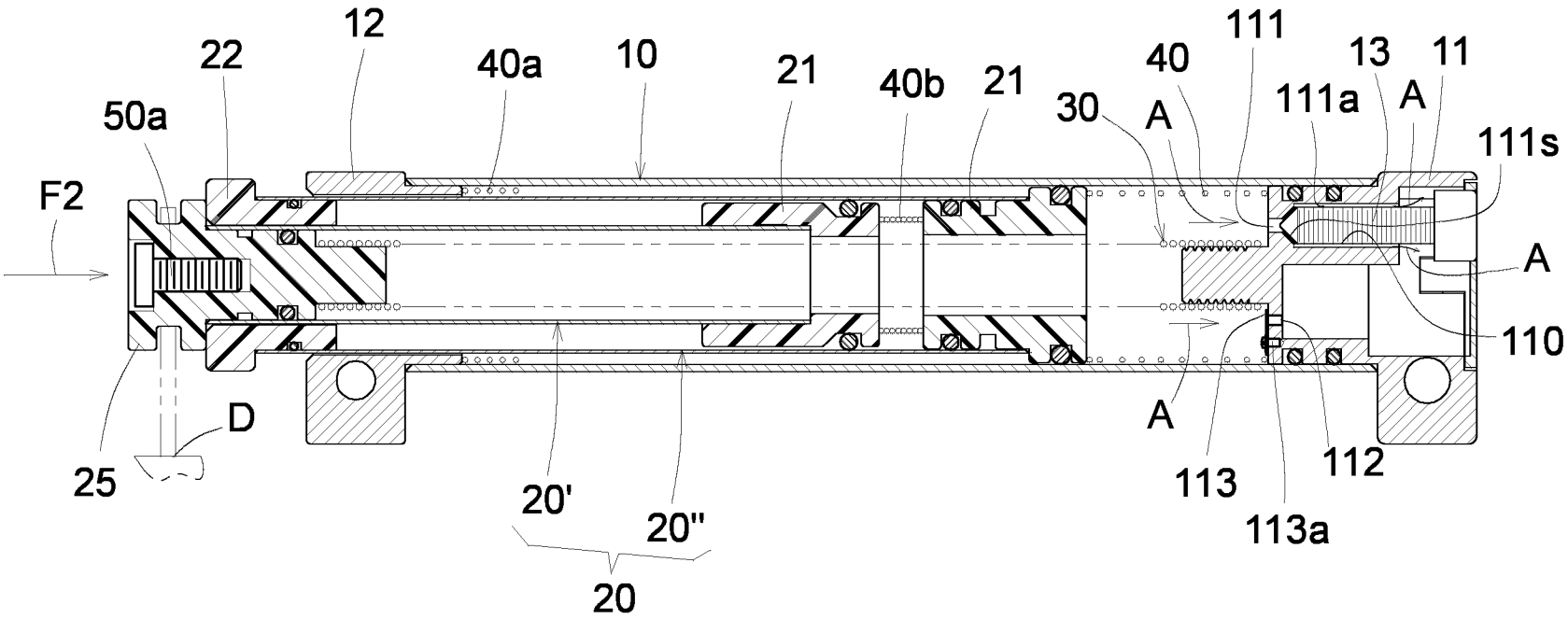
FIG. 11 shows a retraction of the rod member as retracted from FIG. 10.

An auxiliary buffer member 40*a* is formed on the end retainer 12 to serve as a buffer for the piston 21 when opening the door. An intermediate buffer member 40*b* is resiliently retained in between the piston 21 and the inner piston 21' to serve as a buffer when closing the door D (as numeral F2 shown in FIG. 11) between the pistons 21, 21', in addition to the buffer effect as effected by the buffer member 40 held between the piston 21 and the cylinder head 11. Such buffer members 40, 40*a*, 40*b* may help dampen the impact force or inertia force caused during closing or opening of the door to prevent damage of the elements of door closer and also to eliminate noise thus caused.

As shown in FIGS. 1, 6, 8, 12 and 13, the door closer of the present invention further comprises a magnetic coupling consisting of a first magnetic coupling member or a magnet 50*a* and a second magnetic coupling member or a ferromagnetic member 50*b* magnetically attracted each other. The magnet 50*a* is installed on an outer end of the rod member 20 (or the inner tube 20'), while the ferromagnetic member 50*b* is installed on the door frame Df or a frame or bracket F formed on the door frame or on a building structure to be magnetically attracted with the magnet 50*a* when opening the door by pulling the rod member 20 outwardly (FIGS. 10, 12), to thereby hold the door temporarily at an opening state and to allow the user to coming-in and/or going-out through such a temporarily opened door. By pulling the door inwardly by initially overcoming the magnetic attraction force between the magnet 50*a* and the ferromagnetic member 50*b*, the ferromagnetic member 50*b* will then be separated from the magnet 50*a*, allowing a door closing operation as restored by the restoring spring 30 for automatically closing the door.

Naturally, the ferromagnetic member 50*b* may be substituted with a second magnet having a polarity opposite to that of the first magnet 50*a* so that the first magnet 50*a* and the second magnet 50*b* will be magnetically attracted together for temporarily opening the door, similar as aforementioned.

Figure 12:
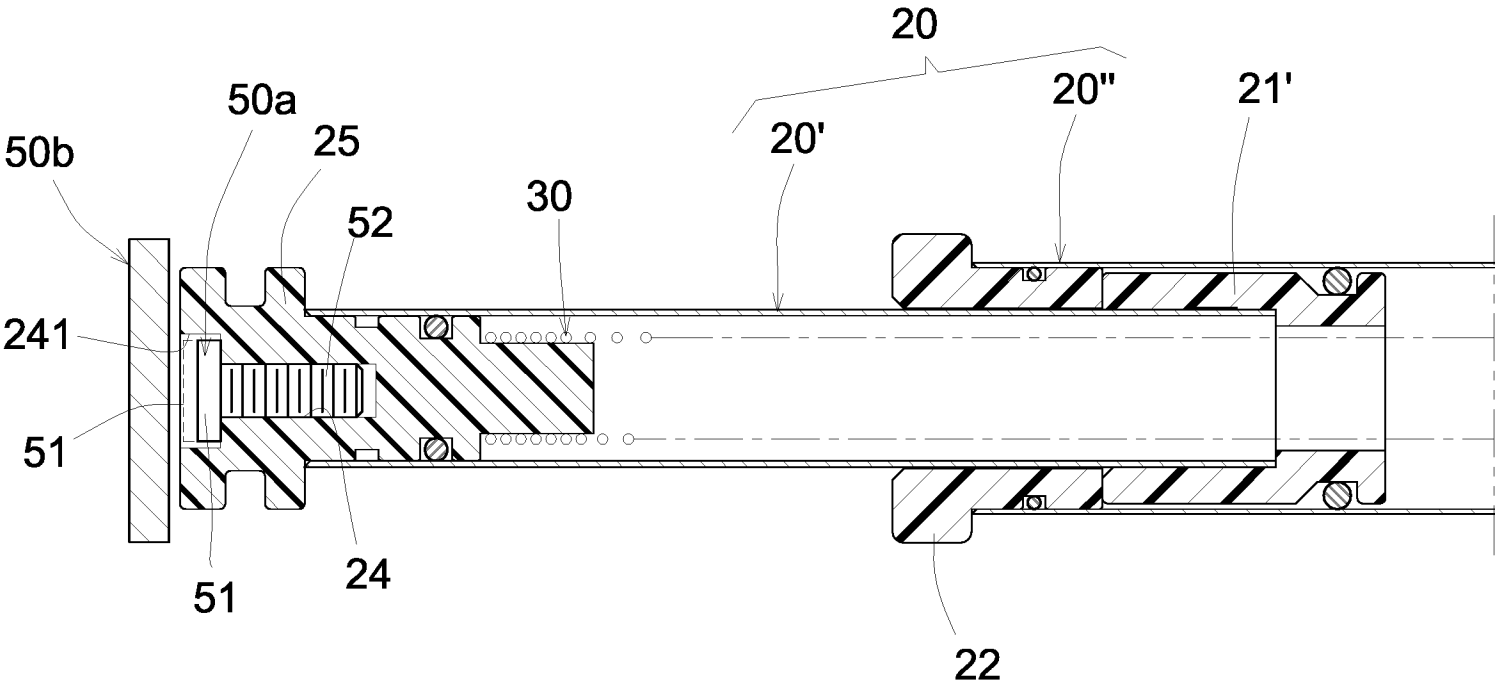
FIG. 12 is an illustration showing attraction of the magnet on the rod member with the ferromagnetic member.
Figure 13:
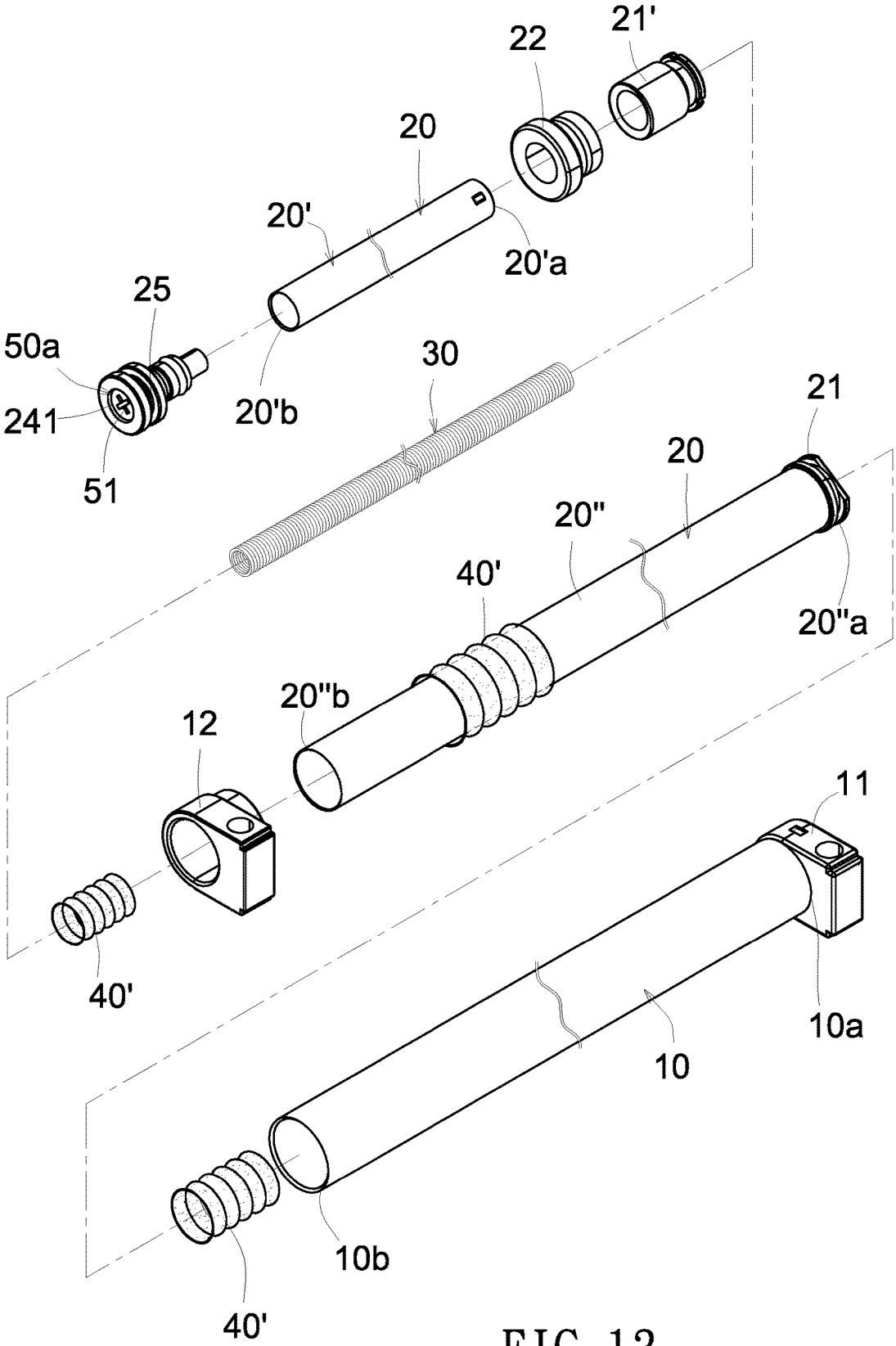
FIG. 13 is a perspective view of a third preferred embodiment of the present invention.

As shown in FIG. 12, the magnet 50*a* may include a magnetic head 51, and a screw portion 52 secured with the magnetic head 51, in which the screw portion 12 is adjustably mounted in a screw hole 24 formed in an outer end portion of the rod member 20, 20'. Such a screw hole 24 is formed in a recess 241 as recessed in an outermost end portion of the rod member 20, 20'. The screw hole 24 has a depth which is larger than a thickness or height of the magnetic head 51, thereby allowing an inward or outward adjustment of the magnetic head 51 within the recess 241 (FIG. 12), and, in turn, allowing an adjustment of the distance between the magnet 50*a* and the ferromagnetic member 50*b* for adjusting the magnetic force therebetween as required by the user.

The recess 241 in the screw hole 24 may be formed in the pulling member 25 formed on the outer end portion of the rod member 20. The pulling member 25 should therefore be made of non-magnetic materials.

The present invention is superior to the conventional door closer with the following advantages:

1. When opening the door, all the main valve V1 and the check valve V2 are opened to enter air quickly into the buffer chamber C to relieve vacuum in the chamber C so as to allow the piston 21 and rod member 20 to be pulled outwardly quickly and to easily open the door with a lighter force.
2. When closing the door, the piston and rod member are restored by the restoring spring to compress the air in the buffer chamber C to thereby close the check valve V2 (hole 112). At this time, the air in the chamber C will be expelled outwardly only through the main valve V1 (hole 111) such that the air existing in the chamber C will serve as a buffer to dampen the restoring force or the inertia of the retracting piston 21 and rod member 20 so as to prevent damage of the parts of the door closer and to eliminate noise thus caused.
3. As implemented by the magnetic coupling 50*a*, 50*b*, the door can be temporarily opened by attracting the magnet 50*a* to the ferromagnetic member 50*b*, thereby keeping the door at a temporary opening state and allowing a convenient in-and-out for the user or people.

The present invention may be further modified without departing from the spirit and scope of the present invention. The door closer of this invention may be applied to a sliding door slidably moving in a door frame and/or a hinged door pivotally secured to a door frame, not limited herein.

I claim:

1. A door closer comprising:

a cylinder secured on a door frame and having a cylinder head formed on a first end of said cylinder and an end retainer formed on a second end of said cylinder;

a rod member comprising an outer tube having a first end secured with a piston slidably reciprocating in said cylinder and a second end secured with a tube retainer; and an inner tube having an inner end secured with an inner piston slidably reciprocating within said outer tube and having an outer end secured with a pulling member to be secured with a door on said pulling member;

said inner tube and said outer tube being telescopically engaged with each other; and a restoring spring retained between said cylinder head and an outer end portion of said inner tube for resiliently restoring said inner and outer tubes towards said cylinder head for closing the door; and a buffer chamber defined within said piston, said cylinder head and said cylinder;

a main valve and a check valve respectively formed on said cylinder head; and at least a buffer member formed in said cylinder to serve as a buffer when moving said piston and said rod member in said cylinder;

whereby upon pulling of said rod member and said piston outwardly for opening said door, both said main valve and said check valve will be opened to relieve a vacuum in said buffer chamber for quickly opening the door in a light force; and when closing the door, said piston is restored inwardly as effected by said restoring spring and said main valve is opened to release air outwardly, and simultaneously said check valve will be closed to allow the air in the buffer chamber to dampen said piston and said rod member for preventing damage of said door closer and eliminating noise when closing the door; and further comprising a magnetic coupling having a first magnetic coupling member secured to an outer end portion of said inner tube of said rod member, and a second magnetic coupling member formed on a bracket or on said door frame at a location whereon the door is temporarily opened, whereby upon pulling of said rod member for opening the door, the first magnetic coupling member will be magnetically attracted to said second magnetic coupling member for temporarily opening the door; said magnetic coupling having a magnetic attraction force larger than a restoring force of said restoring spring.

2. A door closer according to claim 1, wherein said first magnetic coupling member is secured on an outer end portion of said inner tube of said rod member to be magnetically attracted to said second magnetic coupling member when opening the door; said magnetic coupling having a magnetic attraction force larger than a restoring force of said restoring spring.

3. A door closer according to claim 1, wherein said main valve comprises:

a plug rotatably mounted in a female threaded hole formed in the cylinder head, a valve seat formed in said cylinder head to be engaged with said plug and a main hole formed through the valve seat, and an air passage diametrically recessed in said female threaded hole and communicated with said main hole for allowing air in-and-out through said air passage and said main hole when opening the plug, whereby upon adjustment of a distance between said plug and said valve seat, an air opening can be adjusted to adjust air volumetric flow rate, as passing through said main hole, and entering said buffer chamber.

4. A door closer according to claim 1, wherein said rod member further comprises an intermediate buffer member resiliently retained between said inner tube and said outer tube.

5. A door closer according to claim 2, wherein said first magnetic coupling member includes a magnetic head, and a screw portion connected with said magnetic head and fixed in a screw hole formed in a pulling member formed on an outer end portion of said inner tube.

6. A door closer according to claim 5, wherein said screw hole is formed with a recess recessed inwardly in an outer end of said screw hole, said recess having a depth larger than a thickness or height of said magnetic head.

7. A door closer according to claim 1, wherein said outer tube further includes an auxiliary buffer member resiliently retained between an end retainer formed on an outer end portion of said cylinder and said piston formed on an inner end portion of said outer tube to serve as a buffer when completely extending said inner and outer tubes outwardly when opening the door.

8. A door closer according to claim 1, wherein said first magnetic coupling member is a magnet, and said second magnetic coupling member is a ferromagnetic member magnetically attracted to said magnet.

9. A door closer according to claim 1, wherein said magnetic coupling includes a first magnet and a second magnet having polarities being opposite with each other.

10. A door closer according to claim 1, wherein said check valve includes a flap pivotally secured to a check-valve hole formed through said cylinder head operatively opened for allowing air entering said buffer chamber through said check-valve hole when opening the door, and operatively closed to stop air releasing from said check-valve hole when closing the door.

11. A door closer according to claim 1, wherein said buffer member is a compression spring retained between said cylinder head and said piston when closing the door; or retained on an end retainer of said cylinder to be retained between said piston and said end retainer of said cylinder when opening the door; or retained between an inner tube and an outer tube of said rod member.

* * * * *